US010882163B2

(12) United States Patent
Sweeney

(10) Patent No.: US 10,882,163 B2
(45) Date of Patent: Jan. 5, 2021

(54) WRENCH

(71) Applicant: ECM Industries, LLC, Menomonee Falls, WI (US)

(72) Inventor: Matthew W. Sweeney, Ringwood, IL (US)

(73) Assignee: ECM Industries, LLC, Menomonee Falls, WI (US)

( * ) Notice: Subject to any disclaimer, the term of this patent is extended or adjusted under 35 U.S.C. 154(b) by 0 days.

(21) Appl. No.: 16/357,057

(22) Filed: Mar. 18, 2019

(65) Prior Publication Data

US 2019/0210198 A1 Jul. 11, 2019

Related U.S. Application Data

(63) Continuation of application No. 14/883,407, filed on Oct. 14, 2015, now abandoned.

(Continued)

(51) Int. Cl.
*B25B 13/00* (2006.01)
*B25B 13/50* (2006.01)

(Continued)

(52) U.S. Cl.
CPC ..... *B25B 13/50* (2013.01); *B25B 13/08* (2013.01); *B25B 13/481* (2013.01)

(58) Field of Classification Search
CPC ..... B25B 13/50; B25B 13/481; B25B 13/08; B25B 13/00; B25B 19/00; B25B 13/5033;

(Continued)

(56) References Cited

U.S. PATENT DOCUMENTS 1,384,684 A 7/1921 Watkins
1,784,535 A 12/1930 Osterby (Continued)

FOREIGN PATENT DOCUMENTS

CN 3620453 3/2007
CN 301512295 4/2011

(Continued)

OTHER PUBLICATIONS

Gardner Bender-Gardner Bender LNW-500 Locknut Wrench, 1/2 Inch., Loosen, Date first available Jan. 31, 2015, [online] retrieved Mar. 18, 2020, available from Internet, www.amazon.com (Year 2015).

(Continued)

*Primary Examiner* — Lawrence Averick
(74) *Attorney, Agent, or Firm* — Michael Best & Friedrich LLP

(57) ABSTRACT

A locknut wrench and method. The wrench may include a handle extending along an axis and having opposite sides; a first hook portion at one end of the handle, the first hook portion extending from the axis to a first hook member about a first angle, the first hook member being selectively engageable with a tab of a locknut; and a second hook portion at an opposite end of the handle, the second hook portion extending from the axis to a second hook member about a second angle different than the first angle, the second hook member being selectively engageable with a tab of a locknut, the second hook portion including a tooth positioned on a side of the handle opposite the second hook member, the tooth extending from the axis to an end about a third angle.

20 Claims, 17 Drawing Sheets

Fig. 3

Related U.S. Application Data

(60) Provisional application No. 62/067,227, filed on Oct. 22, 2014.

(51) Int. Cl.
*B25B 13/08* (2006.01)
*B25B 13/48* (2006.01)

(58) Field of Classification Search
CPC ..... B25B 27/0071; B25B 23/00; B25B 13/02; B25B 23/06; B60B 29/003; B25G 1/005; B25F 1/00; F16B 21/18; F16B 27/00
See application file for complete search history.

(56) References Cited

U.S. PATENT DOCUMENTS

| | | | | |
|---|---|---|---|---|
| D135,158 | S | 3/1943 | Miller | |
| 2,334,069 | A * | 11/1943 | Collins | B25B 13/02 81/119 |
| D176,974 | S | 2/1956 | Brown | |
| D186,131 | S | 9/1959 | Wallace | |
| 3,003,379 | A | 10/1961 | Pribitzer | |
| 3,292,465 | A | 12/1966 | Mulligan | |
| 3,641,846 | A | 2/1972 | Prial | |
| 3,949,439 | A | 4/1976 | Ardis | |
| D252,907 | S | 9/1979 | Poll | |
| D255,773 | S | 7/1980 | Raske | |
| D263,674 | S | 4/1982 | Ebert | |
| 4,688,454 | A | 8/1987 | Scull | |
| 4,967,435 | A | 11/1990 | Seals | |
| 5,033,501 | A | 7/1991 | Stehling | |
| D329,788 | S | 9/1992 | Andrew | |
| 5,247,715 | A | 9/1993 | Mnishiguchi | |
| 5,303,439 | A | 4/1994 | Seals | |
| 5,520,210 | A | 5/1996 | Barton | |
| 5,551,322 | A | 9/1996 | Mikic et al. | |
| RE35,424 | E | 1/1997 | Seals | |
| D404,267 | S | 1/1999 | Hedin | |
| D422,466 | S | 4/2000 | Kovach | |
| 6,295,901 | B1 | 10/2001 | Mardirossian | |
| 6,389,933 | B1 | 5/2002 | Chen | |
| 6,705,182 | B2 | 3/2004 | Bennett | |
| D489,234 | S | 5/2004 | Pyper et al. | |
| 6,868,761 | B2 | 3/2005 | Stoick et al. | |
| 7,000,506 | B1 | 2/2006 | Steen | |
| 7,156,000 | B2 * | 1/2007 | Wroblewski | B25B 13/48 81/119 |
| 7,210,381 | B2 | 5/2007 | Crawford | |
| D598,723 | S * | 8/2009 | Cheng | D8/17 |
| D663,176 | S | 7/2012 | Dixon, III | |
| 8,485,072 | B2 | 7/2013 | Swing | |
| D690,567 | S | 10/2013 | Lamarra | |
| D742,706 | S | 11/2015 | Sui | |
| 9,452,511 | B2 | 9/2016 | Nguyen | |
| 9,649,752 | B1 | 5/2017 | Garrison | |
| D790,936 | S | 7/2017 | Leys et al. | |
| 9,694,481 | B2 | 7/2017 | Hayes, Jr. | |
| D811,183 | S | 2/2018 | Leys et al. | |
| D866,275 | S | 11/2019 | Zhou | |
| 2001/0027705 | A1 | 10/2001 | Hsieh | |
| 2002/0083800 | A1 | 7/2002 | Bennett | |
| 2004/0055427 | A1 | 3/2004 | Stier | |
| 2004/0144220 | A1 | 7/2004 | Stoick et al. | |
| 2004/0237728 | A1 | 12/2004 | Wroblewski | |
| 2005/0103167 | A1 | 5/2005 | Stewart et al. | |
| 2007/0051211 | A1 | 3/2007 | Stewart et al. | |
| 2008/0022813 | A1 | 1/2008 | Farrell | |
| 2012/0125162 | A1 * | 5/2012 | Nguyen | B25B 13/48 81/124.4 |
| 2015/0128769 | A1 | 5/2015 | Albrecht | |
| 2016/0075005 | A1 | 3/2016 | Hayes, Jr. | |
| 2017/0136609 | A1 | 5/2017 | Stanley | |

FOREIGN PATENT DOCUMENTS

| | | |
|---|---|---|
| CN | 303504286 | 12/2015 |
| GB | 2071826 | 6/1998 |
| JP | D1526248 | 6/2015 |

OTHER PUBLICATIONS

Gardner Bender, Gardner Bender-LNW-1000 Locknut Wrench, 1 Inch., Loosen, Date first available Jan. 31, 2015, [online] retrieved Mar. 23, 2020, available from internet, www.amazon.com (Year 2015).

Motion, Motion Pro 08-0029 Shock Spanner Wrench, Date first available Jan. 30, 2007, retrieved Jul. 2, 2020, available from Internet, <www.amazon.com>.

Icon, Icon 198000 Spanner Wrench for Coil-Over Shock, Date first available Apr. 25, 2014, retrieved Jul. 2, 2020, available from Internet, <www.amazon.com>.

* cited by examiner

WRENCH

RELATED APPLICATIONS

The present application is a continuation of U.S. patent application Ser. No. 14/883,407, filed Oct. 14, 2015, which claims priority to U.S. Provisional Patent Application No. 62/067,227, filed Oct. 22, 2014, the entire contents of both of which are hereby incorporated by reference.

FIELD

The present invention relates generally to wrenches, and, more particularly, to locknut wrenches.

SUMMARY

In one independent embodiment, a wrench may include a handle; a first hook portion at one end of the handle, the first hook portion extending about a first angle; and a second hook portion at an opposite end of the handle, the second hook portion extending about a second angle different than the first angle.

In another independent embodiment, a wrench may include a handle extending along an axis and having opposite sides; a first hook portion at one end of the handle, the first hook portion extending from the axis to a first hook member about a first angle; and a second hook portion at an opposite end of the handle, the second hook portion extending from the axis to a second hook member about a second angle, the second hook portion including a tooth positioned on a side of the handle opposite the second hook member, the tooth extending from the axis to an end about a third angle.

In yet another independent embodiment, a wrench may be operable to adjust a locknut, the locknut including a plurality of tabs, each tab having an outer surface providing a portion of an outer circumferential surface of the locknut. The wrench may include a handle extending along an axis and having opposite sides; a first hook portion at one end of the handle, the first hook portion extending from the axis to a first hook member about a first angle, the first hook member being selectively engageable with a tab of the locknut when the first hook portion engages the locknut; and a second hook portion at an opposite end of the handle, the second hook portion extending from the axis to a second hook member about a second angle different than the first angle, the second hook member being selectively engageable with a tab of the locknut when the second hook portion engages the locknut, the second hook portion including a tooth positioned on a side of the handle opposite the second hook member, the tooth extending from the axis to an end about a third angle.

In a further independent embodiment, a method of installing a locknut, the locknut including a number of tabs, may be providing. The method may generally include providing a wrench including a handle, a first hook portion at one end of the handle, the first hook portion extending about a first angle, and a second hook portion at an opposite end of the handle, the second hook portion extending about a second angle different than the first angle; positioning the locknut for installation on an electrical box; engaging one of the first hook portion and the second hook portion with a tab of the locknut; pivoting the locknut until the wrench engages a portion of the box to limit further pivoting movement; engaging the other of the first hook portion and the second hook portion with a tab of the locknut; and pivoting the locknut.

Independent features and/or independent advantages of the invention may become apparent to those skilled in the art upon review of the detailed description, claims and drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Constructions of a wrench, such as a locknut wrench 10, 10', 10A, 10B, 10C are illustrated in FIGS. 1-16. Each wrench 10, 10', 10A, 10B, 10C is operable (see FIGS. 9A-10 and 15A-16) to adjust (install, remove, tighten, loosen) locknuts N relative to an electrical conduit connector C on an electrical box. A similar electrical conduit connector is illustrated and described in U.S. Pat. No. 7,156,000, the entire contents of which is hereby incorporated by reference.

The illustrated wrenches 10, 10', 10A, 10B, 100 allow relatively easy installation of conduit locknuts N. Dual ends on each wrench 10, 10', 10A, 10B, 100 are provided to allow the illustrated wrench 10, 10', 10A, 10B, 10C to engage locknut tabs T in areas with restricted access (see, e.g., FIGS. 9A-9B and 15A-15B). Each wrench 10, 10', 10A, 10B, 100 is generally lightweight and has a small profile. The illustrated wrenches 10, 10', 10A, 10B, 100 are formed of through hardened, medium carbon steel with a black e-coat (electrophoretic or electrocoat paint). In other constructions, the wrenches 10, 10', 10A, 10B, 100 may be formed of case hardened, low carbon steel and/or may be black oxide coated.

The illustrated wrench 10, 10', 10A, 10B, 100 includes a hook type spanner wrench and is generally sized to mate with locknuts meeting UL514B, the entire contents of which is hereby incorporated by reference. The number of tabs on a locknut is not controlled by UL514B. The most common are six and eight tab locknuts. The illustrated wrenches 10, 10', 10A, 10B, 10C will work with at least both of these types of locknuts.

Figure 1:
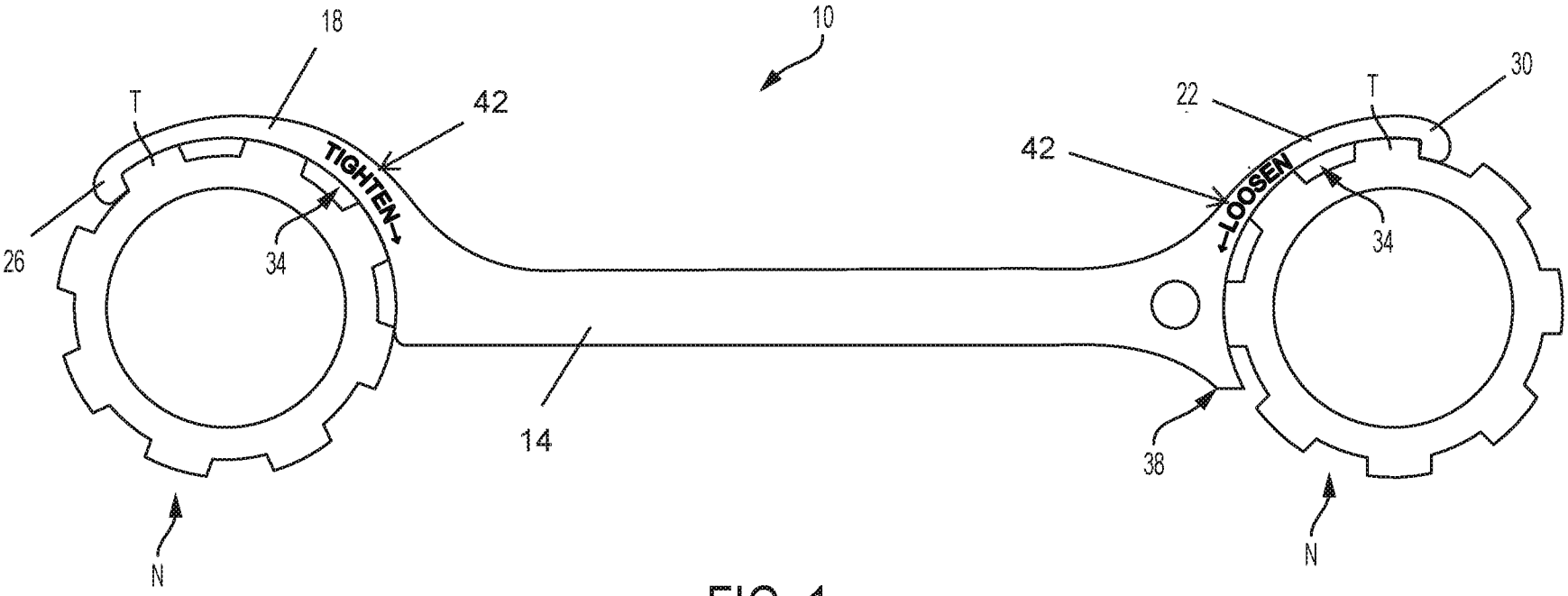
FIG. 1 is a side view of a wrench, such as a locknut wrench, engaged with locknuts.
Figure 2:
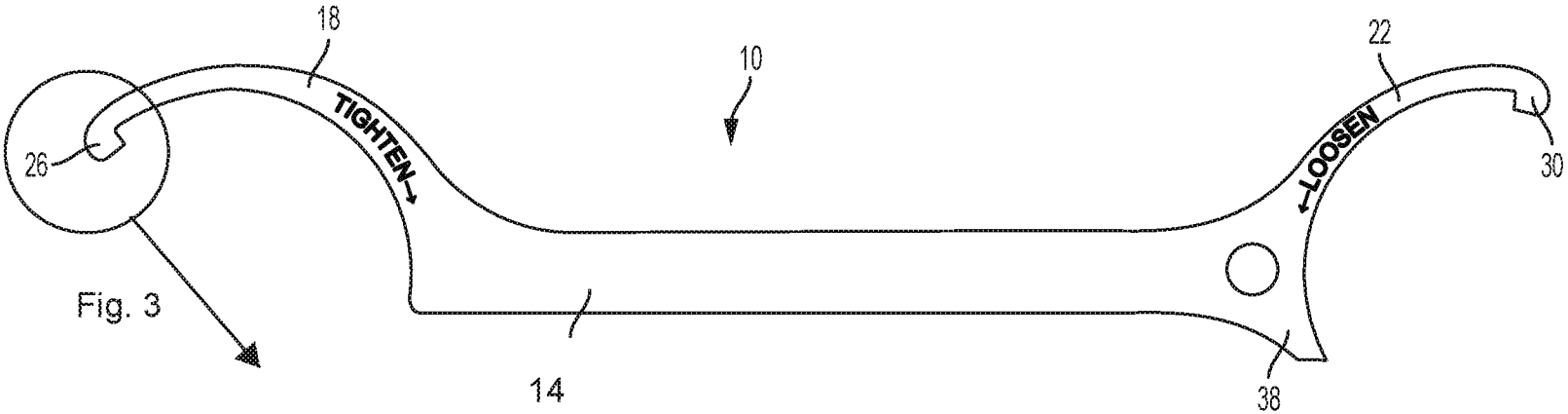
FIG. 2 is a side view of the wrench shown in FIG. 1.

As shown in FIG. 1, the wrench 10 includes a handle 14 and hook portions 18, 22 at opposite ends and with respective hook members 26, 30. The hook portions 18, 22 extend in opposite directions from the handle 14 (e.g., counterclockwise and clockwise, respectively, in FIG. 1). Each hook portion 18, 22 has substantially the same radius suitable for the associated sized locknut(s) N. Each hook portion 18, 22 has a circumferential inner surface 34 engageable with the outer radial ends of the tabs T on the locknut N. Each hook member 26, 30 is engageable with a radially-extending side wall of a selected tab T.

In the illustrated construction, each hook portion 18, 22 extends about an angle of less than 180° so that the hook portion 18, 22 can be engaged with the locknut N in a radial direction relative to its axis of rotation. Also, the hook portion 18 on one end extends to a greater extent (e.g., more than 120° (about 130° or about 135° in the illustrated construction)) than the hook portion 22 on the other end (e.g., less than 120° (about 100° or about 105° in the illustrated construction)). The hook member 26 is thus a greater circumferential distance from the edge of the handle 14 than the hook member 30. In other constructions (not shown), the hook portions 18, 22 may extend to a greater (even more than 180°) or to a lesser extent (e.g., 90°) than illustrated.

In order to provide additional circumferential engagement (e.g., about an additional 20° to 30°), the hook portion 22 includes a tooth 38 on the side of the handle 14 opposite the hook member 30. The inner surface 34 of the hook portion 22 is also thus engageable, at least partially, with three tabs T (see, e.g., FIGS. 4 and 6).

One or more markings 42 (see FIG. 1; e.g., characters, words ("TIGHTEN", "LOOSEN") symbols (an arrow), colors, combinations thereof, etc.) are provided proximate each hook member 18, 22 to indicate the selected operation for the hook member 18, 22 in the orientation facing the user. In the illustrated construction, the markings 42 are laser etched, while, in other constructions, other methods (e.g., stamping, molding, printing, etc.) may be used.

FIG. 1 shows the angle of the tab T of the locknut N when engaged with the hook members 26, 30 of the wrench 10. The angle will change if the width of the tab T is different, but the difference between the hook portions 18, 22 will be, for example, about 30° (see FIG. 2). In other constructions (not shown), the difference between the angular extent of the hook portions 18, 22 may be greater (e.g., 45°) or less (e.g., 15°) than illustrated.

Figure 3:
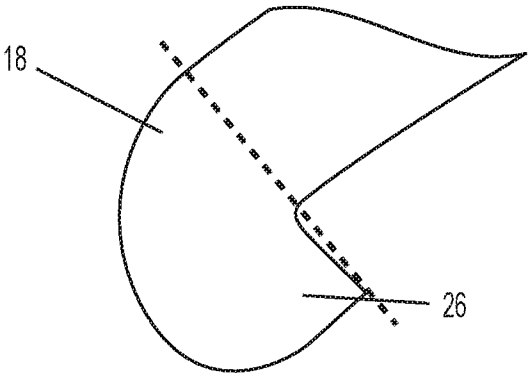
FIG. 3 is an enlarged side view of a hook portion of the wrench shown in FIG. 1.

As shown in FIG. 3, the engagement surface of each hook member 26, 30 is angled relative to a radial line. Each illustrated hook member 26, 30 has an acute point at its end. With this arrangement, the pointed end of each hook member 26, 30 will likely be the first point of contact with the tab T of the locknut N. Also, the pointed end may "bite into" the locknut N to inhibit the wrench 10 from slipping off. In addition, the inner radius (e.g., at the intersection of the hook member 26, 30 and the body of the associated hook portion 18, 22) will be inhibited from interfering with engagement of the hook portion 18, 22 with the locknut N.

Figure 8:
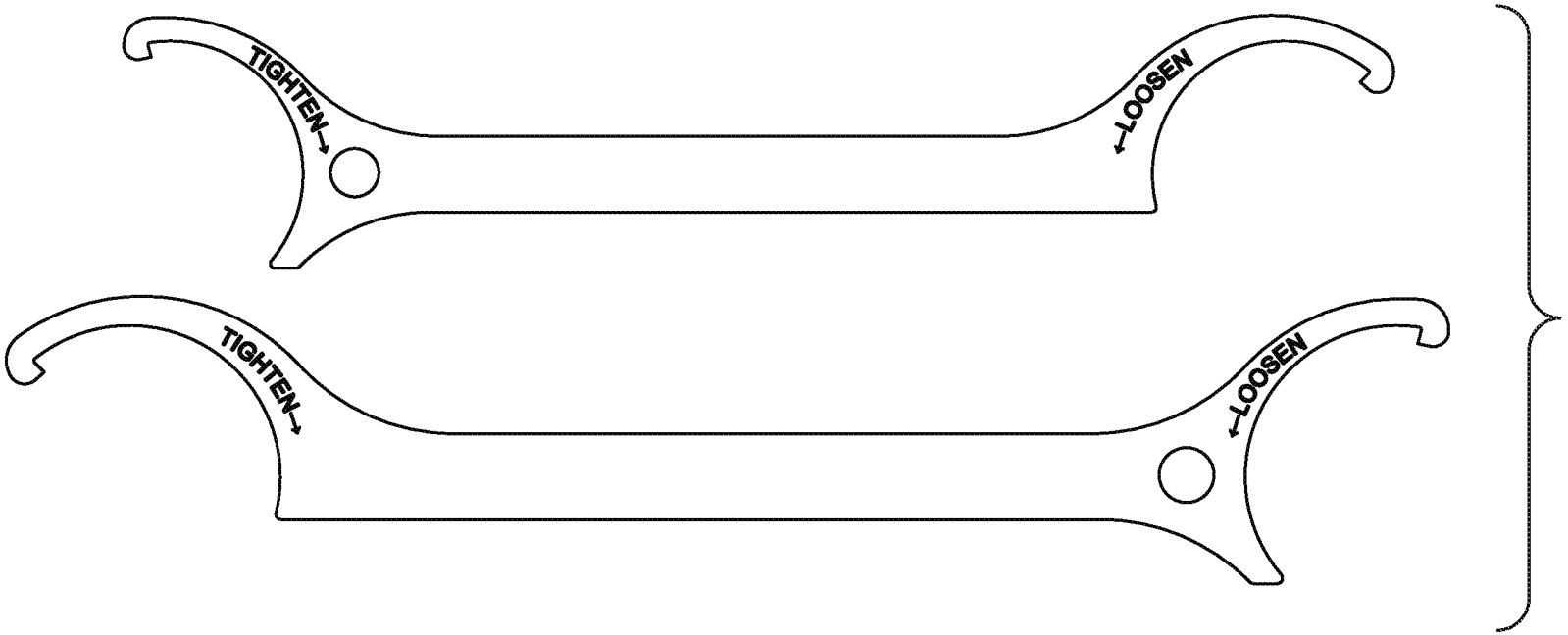
FIG. 8 illustrates a comparison of wrenches for different size locknuts.

FIGS. 4-5 illustrate a wrench 10 for a locknut N of one size (e.g., ½"). FIGS. 6-7 illustrate a wrench 10' for a locknut N of another size (e.g., ¾"). FIG. 8 illustrates a comparison of the different sized wrenches 10, 10' shown in FIGS. 4-7. It should be understood that the wrench 10, 10' may be constructed for locknuts of other sizes (not shown; e.g., 1" 1¼", 1½", 2", etc.).

In FIGS. 4 and 6, the illustrated locknuts N have six tabs T. The hook portion 18 extends circumferentially around three tabs T while the hook portion 22 only partially covers the third tab T. In FIGS. 5 and 7, the illustrated locknuts N have eight tabs T. The hook portion 18 extends circumferentially around four tabs T, partially covering the fourth tab T, while the hook portion 22 extends beyond the third tab T. It should be understood that the wrench 10, 10' may be used with locknuts having a different number of tabs than illustrated.

Figure 9A:
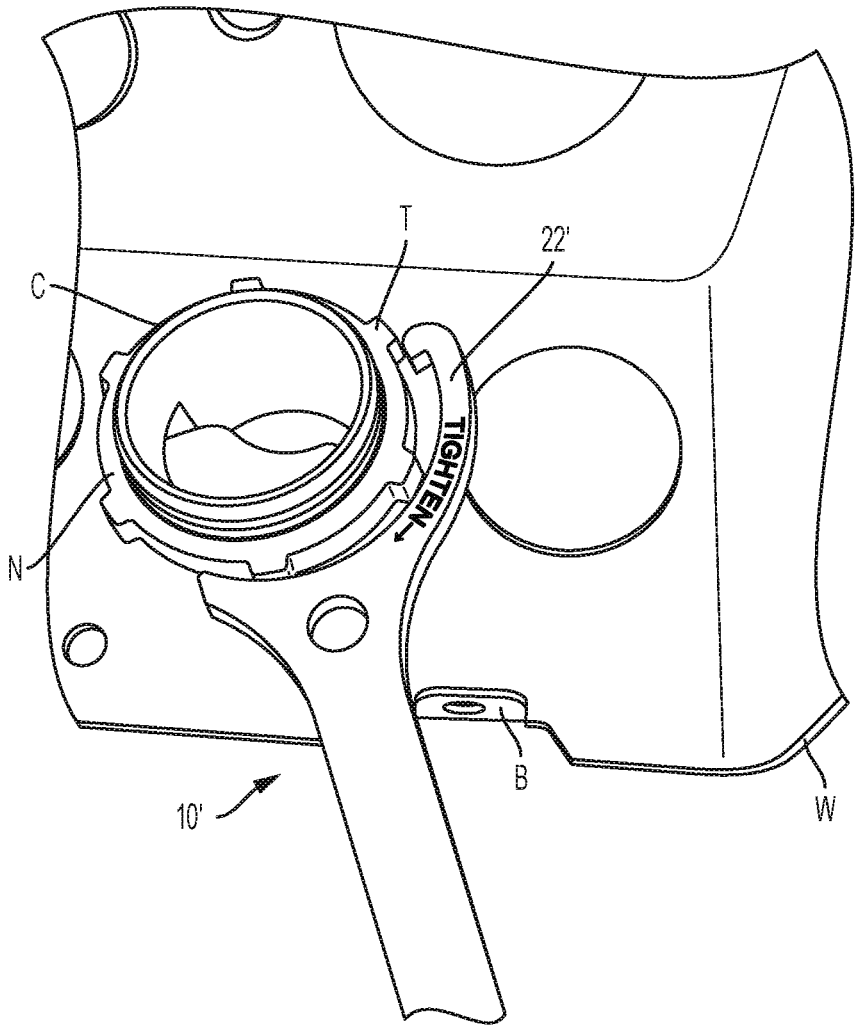
FIGS. 9A-10 illustrate operation of the wrench shown in FIGS. 6A-7D.
Figure 9B:
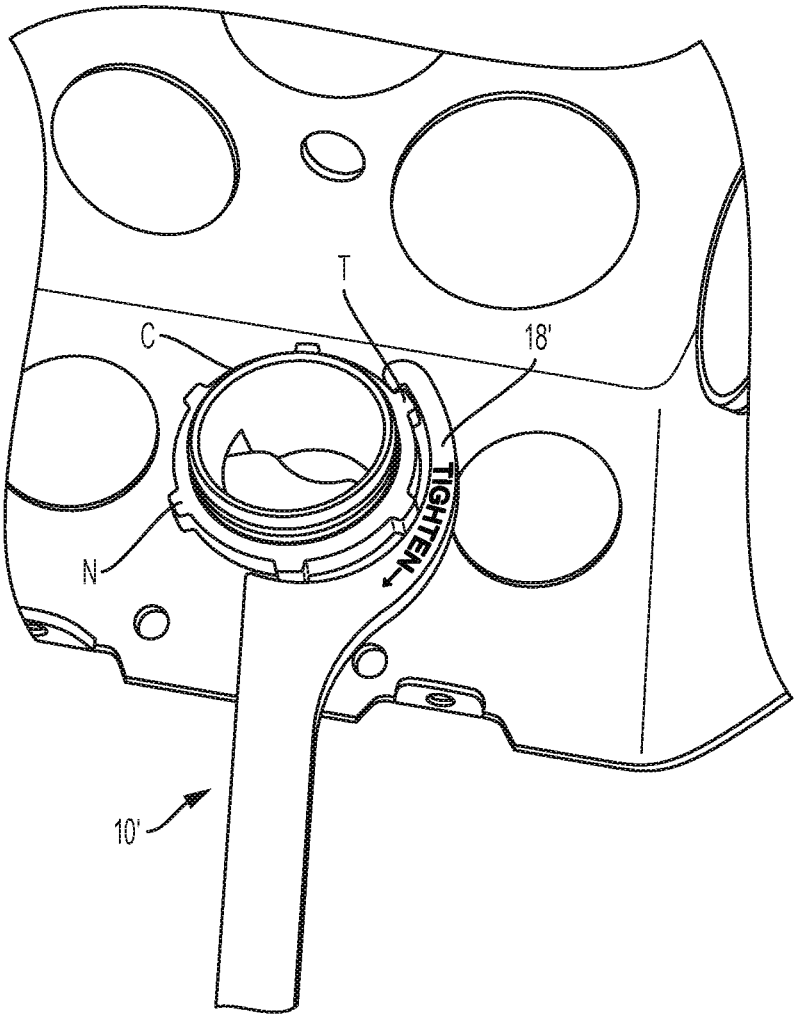
Figure 10:
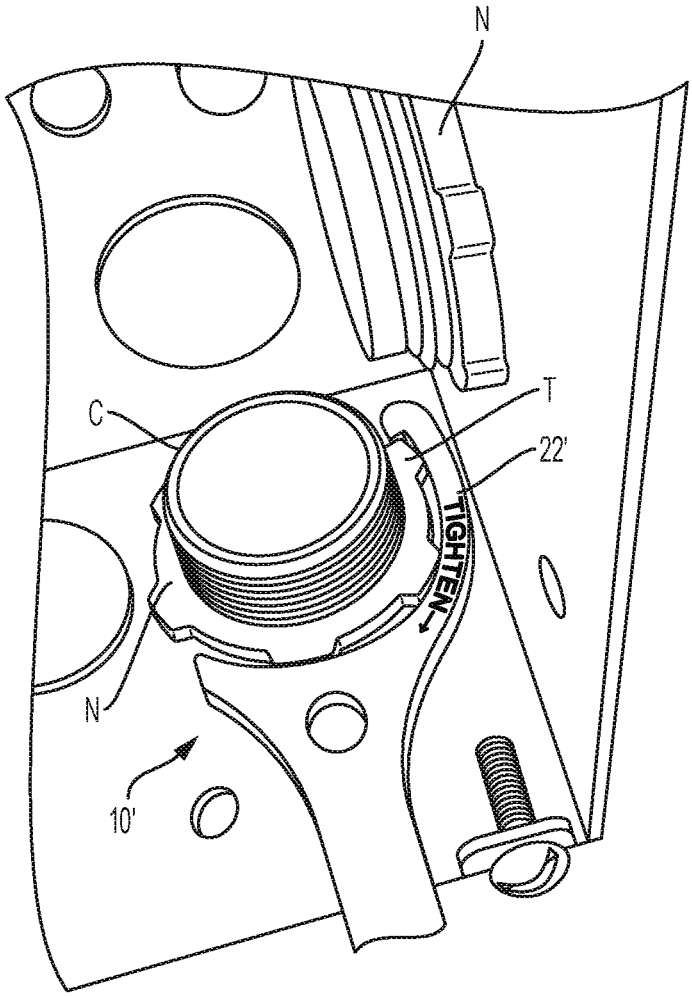

As shown in FIG. 9A, in one orientation, a portion of the box (e.g., the box tab B) may engage a portion of the wrench 10 (e.g., the handle 14) and restrict access to the tab T of the locknut N. Specifically, in this orientation, the hook member 30 is not able to engage the tab T of the locknut N.

In the alternate orientation (see FIGS. 9B and 10), the hook member 26 is in a different position relative to the handle 14. In this alternate orientation, when the hook member 26 engages the tab T on the locknut N, the handle 14 does not engage the tab on the box. Access to the locknut N is no longer restricted.

In operation, a user identifies the size locknut N to be tightened or loosened. The appropriate size wrench 10 (e.g., ½", ¾, 1", etc.) is selected. The wrench 10 is placed with the appropriate marking 42 ("TIGHTEN" OR "LOOSEN") facing outward toward the user.

The user then attempts to engage the associated hook member 26, 30 with the tab T of the locknut N. If the hook member 26, 30 will engage the tab T, the user pivots the wrench 10 in the direction of the arrow in the marking 42 to perform the selected operation (tightening or loosening) for the locknut N.

If, as shown in FIG. 9A, the hook member 30 cannot engage the tab T (e.g., because of restricted access), the opposite end of the wrench 10 (see FIGS. 9B and 10) with the appropriate marking 42 for the selected operation is used to engage the tab T. To orient the opposite end for use, the user flips the wrench 10 (about a vertical axis in FIG. 1). The user pivots the wrench 10 in the direction of the arrow to perform the selected operation (tightening or loosening) for the locknut N.

When the wrench 10 reaches the end of its range of pivoting movement, for example, due to engagement with an obstruction (e.g., the box tab B or box wall W), the wrench 10 is "flipped" to use the opposite end for the selected operation. This process is repeated until the selected operation is completed.

Figure 11A:
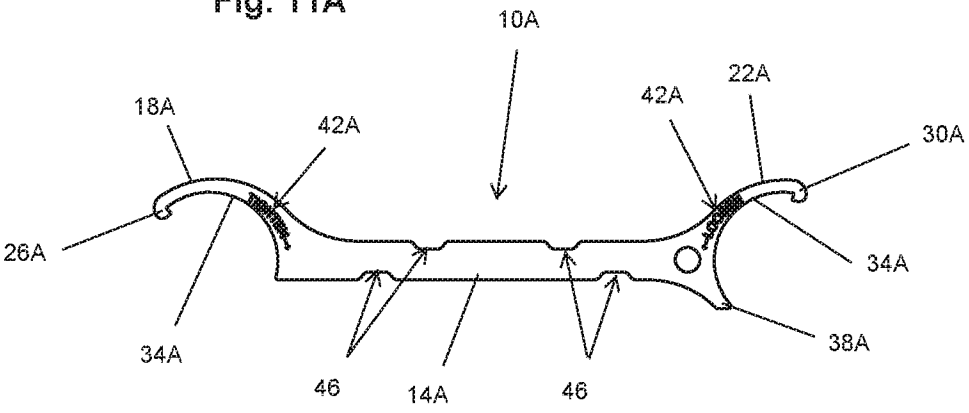
FIGS. 11A-11B are side views of an alternative construction of a wrench, such as a locknut wrench.
Figure 11B:
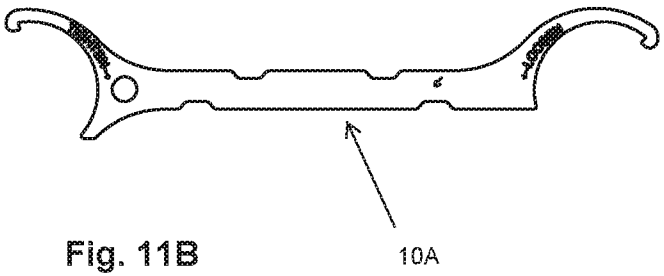

FIGS. 11A-11B illustrate an alternative construction of a wrench 10A for a locknut N of one size (e.g., ½"). The wrench 10A is similar to the wrench 10, and common elements have common reference numbers "A".

As shown in FIGS. 11A-11B, the wrench 10A includes a number of recesses or notches 46 defined in an edge of the handle 14A. In the illustrated construction, two notches 46 are defined in each edge of the handle 14A.

Each notch 46 has a depth transverse to the handle axis to accommodate a box tab B (see FIG. 16) or other obstruction (e.g. a box wall W), thereby increasing the range of pivoting movement of the wrench 10A (e.g., compared to the wrench 10 without notches). Each notch 46 has a length along the handle axis to accommodate obstructions at different radial distances and/or different radial positions relative to the axis of the locknut N.

The notches 46 on each edge are offset from the notches 46 on the opposite edge to, for example, maintain a desired minimum thickness of the handle 14A. Also, in the illustrated construction, the notches 46 on the edge of the handle 14A from which the hook portions 18A, 22A extend (e.g., the top edge of the handle 14A in FIGS. 11A-11B) are positioned a greater distance from the pivot axis of the hook portions 18A, 22A, compared to the notches 46 on the opposite (bottom) edge. In other constructions (not shown), the relative positioning of the notches 46 may be different (e.g., the bottom edge notches 46 may be positioned a greater distance from the pivot axis, the top/bottom notches 46 may alternate being a greater distance from the pivot axis, etc.).

Figure 4A:
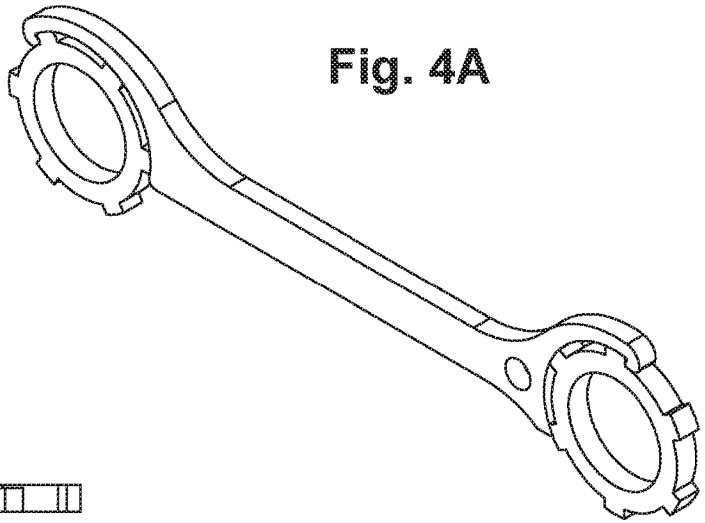
FIGS. 4A-4D include views of a wrench for a locknut of one size and having a number of tabs.
Figure 4C:
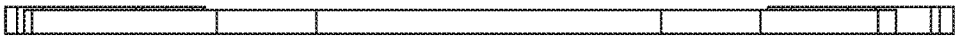
Figure 4D:
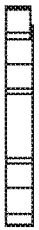
Figure 4B:
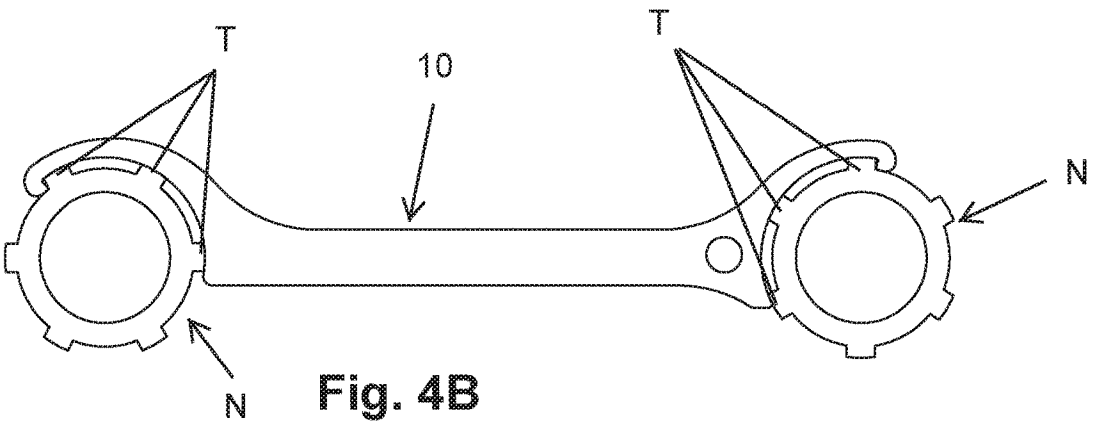
Figure 5A:
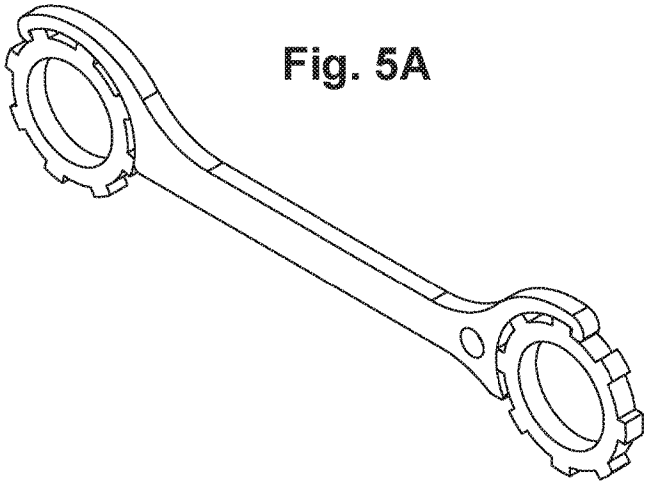
FIGS. 5A-5D include views of the wrench shown in FIGS. 4A-4D, illustrated with a locknut of the one size and having a different number of tabs.
Figure 5B:
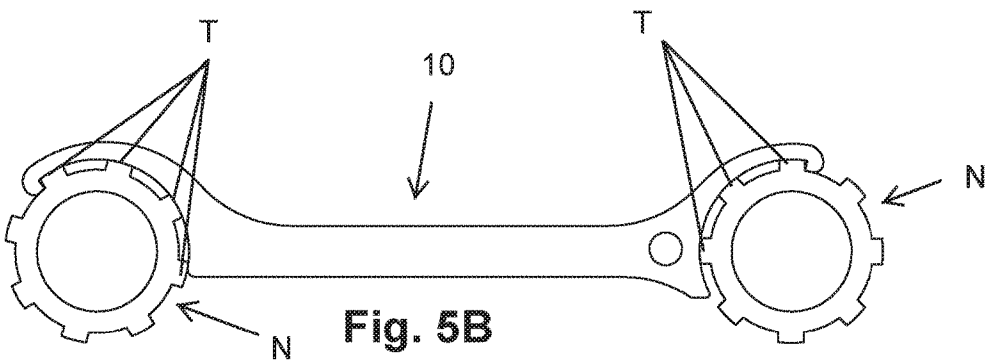
Figure 5C:
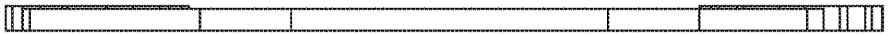
Figure 5D:
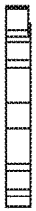

As shown in FIGS. 11A-11B, the tooth 38A has a greater extent than the tooth 38 (see FIGS. 1 and 4B). The extended tooth 38A increases the engagement surface of the wrench 10A and may increase the capacity of the wrench 10A.

Figure 15A:
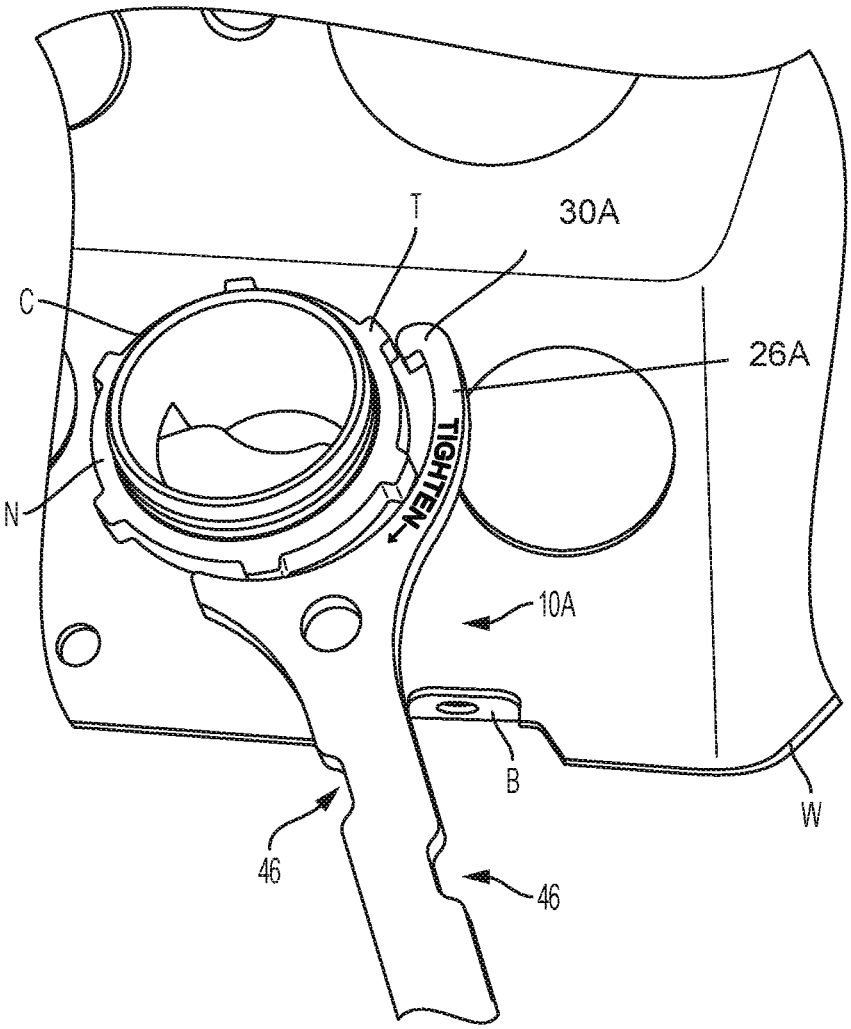
FIGS. 15A-16 illustrate operation of the wrench shown in FIGS. 11A-11B and 14A.
Figure 15B:
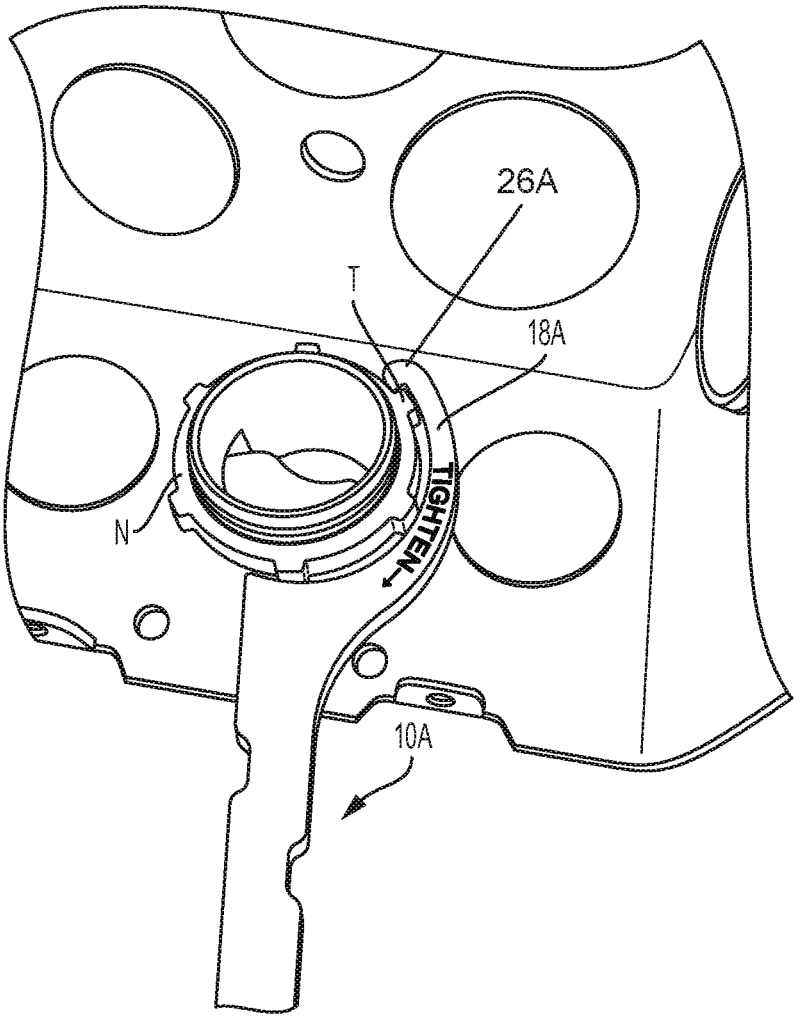
Figure 16:
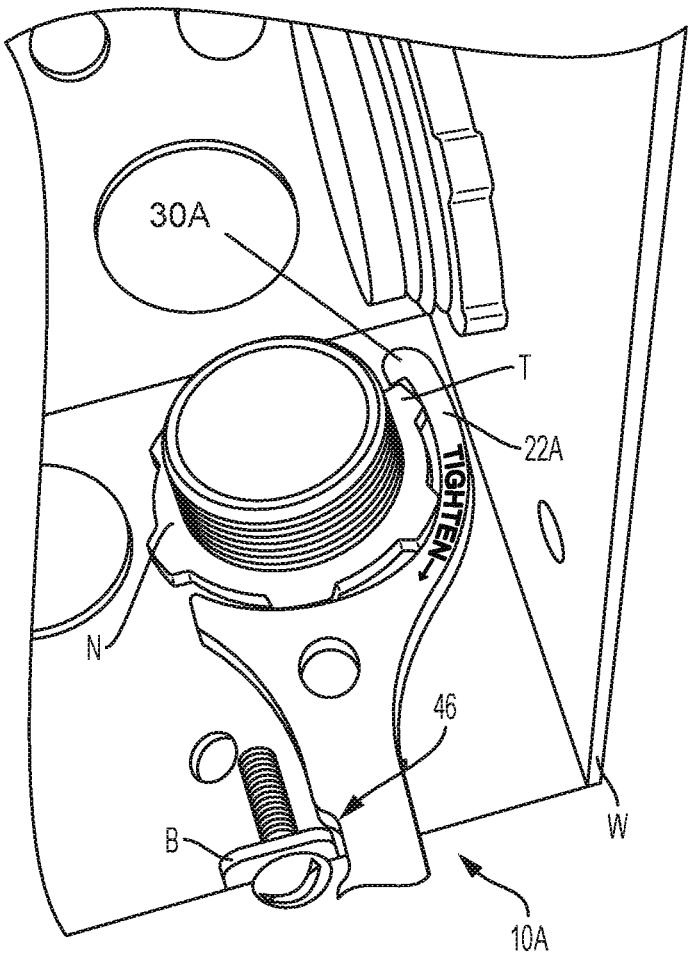

FIGS. 15A-16 illustrate operation of the wrench 10A to install a locknut N. As described above, the user identifies the size locknut N to be tightened or loosened and selects the appropriate size wrench 10A (e.g., ½", ¾", 1", etc.). The wrench 10A is placed with the appropriate marking 42A ("TIGHTEN" OR "LOOSEN") facing outward toward the user.

The user then attempts to engage the associated hook member 26A, 30A with the tab T of the locknut N. If the hook member 26A, 30A will engage the tab T, the user pivots the wrench 10A in the direction of the arrow in the marking 42A to perform the selected operation (tightening or loosening) for the locknut N.

If, as shown in FIG. 15A, the hook member 30A cannot engage the tab T (e.g., because of restricted access), the opposite end of the wrench 10A (see FIG. 15B) with the appropriate marking 42A for the selected operation is used to engage the tab T. To orient the opposite end for use, the user flips the wrench 10A (about a vertical axis in FIG. 11A). The user pivots the wrench 10A in the direction of the arrow to perform the selected operation (tightening or loosening) for the locknut N.

As the wrench 10A is pivoted toward the end of its range of pivoting movement, an obstruction (e.g., the box tab B) is received in the notch 46, thereby allowing additional pivoting movement of the wrench 10A. When the wrench 10A cannot be pivoted further due to the obstruction (see FIG. 16), the wrench 10 is "flipped" to use the opposite end for the selected operation. This process is repeated until the selected operation is completed.

Figure 12A:
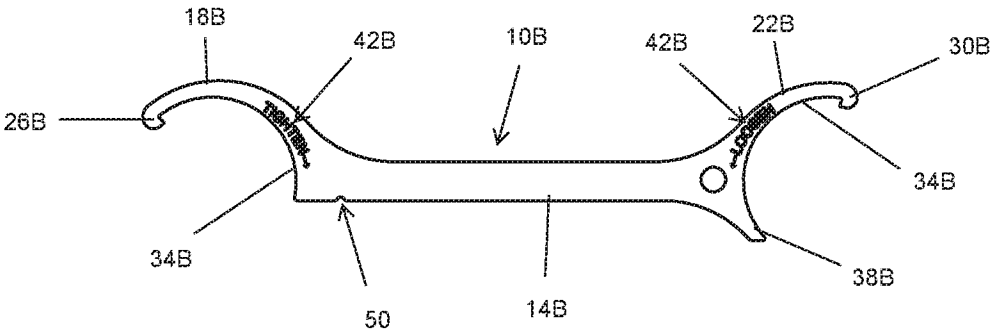
FIGS. 12A-12B are side views of another alternative construction of a wrench, such as a locknut wrench.
Figure 12B:
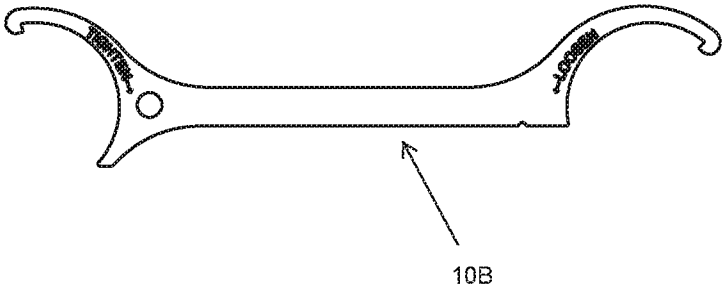

FIGS. 12A-12B illustrate another alternative construction of a wrench 10B for a locknut N of another size (e.g., ¾"). The wrench 10B is similar to the wrench 10, 10', and common elements have common reference numbers "B".

Figure 6A:
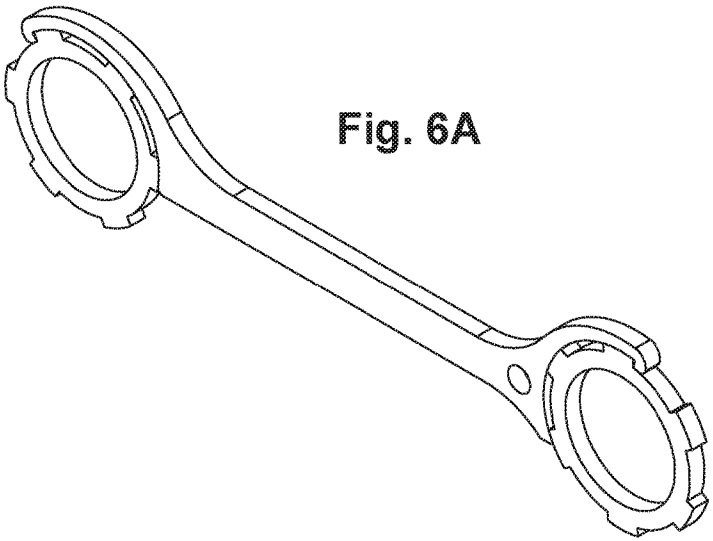
FIGS. 6A-6D include views of a wrench for a locknut of another size and having a number of tabs.
Figure 6C:
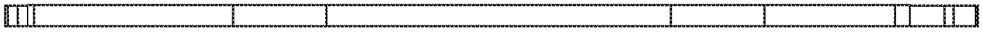
Figure 6B:
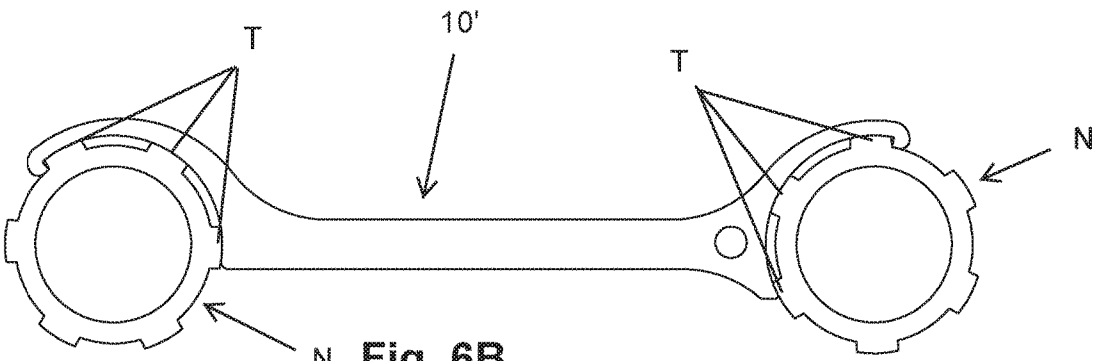
Figure 6D:
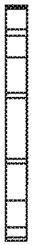
Figure 7A:
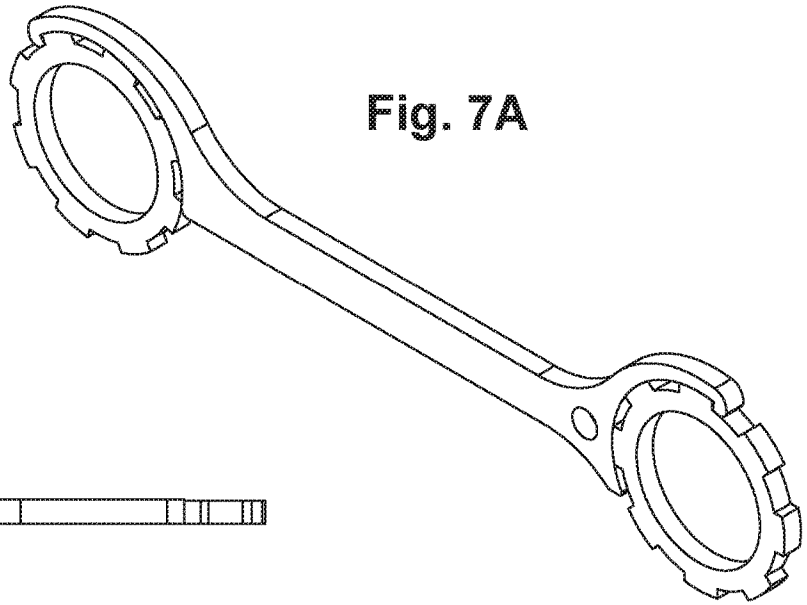
FIGS. 7A-7D includes views of the wrench shown in FIGS. 6A-6D, illustrated with a locknut of the other size and having a different number of tabs.
Figure 7C:
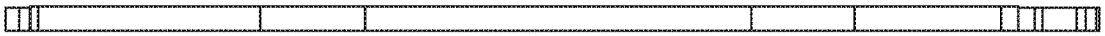
Figure 7D:
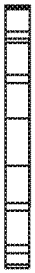
Figure 7B:
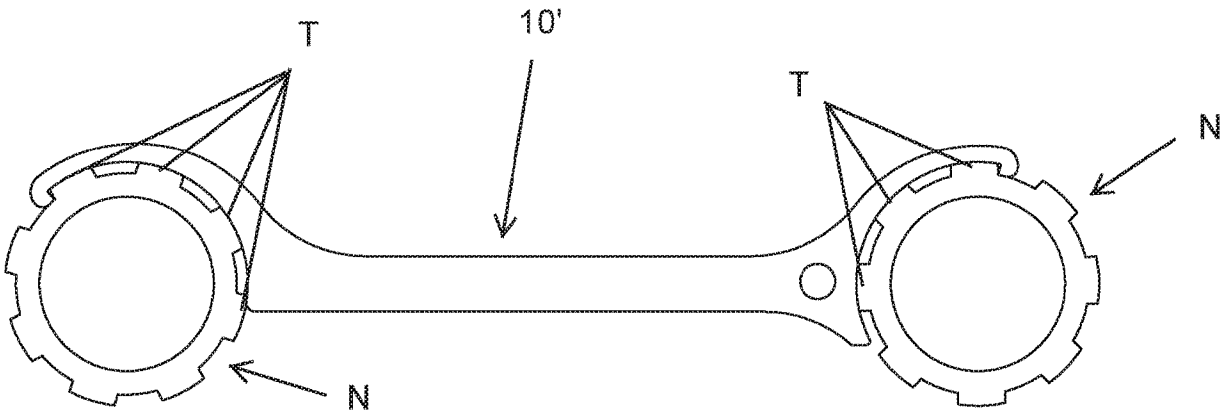

The wrench 10B shown in FIGS. 12A-12B also has an extended tooth 38B compared to the tooth 38 shown in FIG. 6B. The wrench 10B includes a small notch 50 defined on the bottom edge proximate the base of the hook member 18B. The notch 50 is provided so that laser-cutting of the wrench 10B does not leave a sharp portion or barb. In the wrench 10A, the bottom notch 46 for proximate the base of the hook member 18A may provide a similar feature.

Figure 13A:
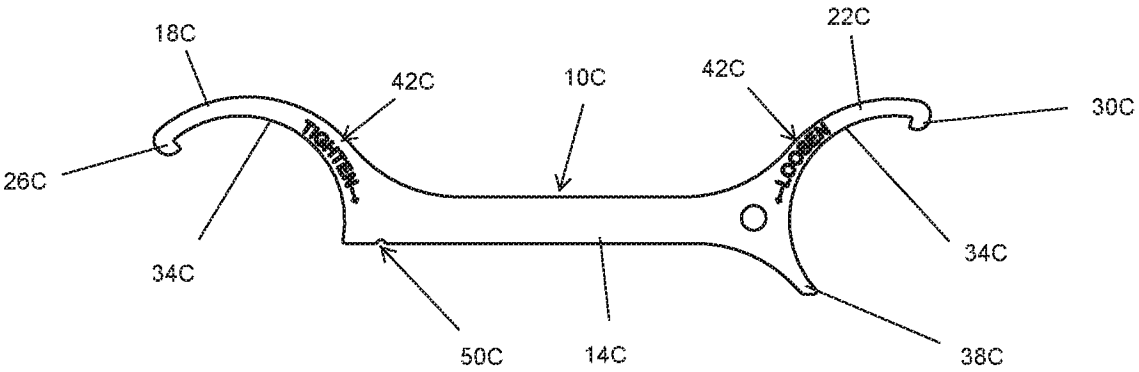
FIGS. 13A-13B are side views of yet another alternative construction of a wrench, such as a locknut wrench.
Figure 13B:
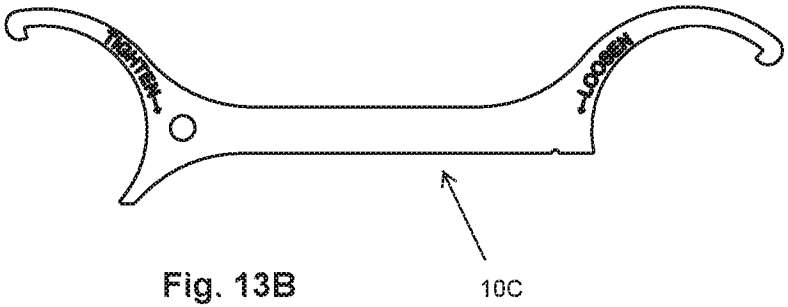

FIGS. 13A-13B illustrate yet another alternative construction of a wrench 100 for a locknut N of another size (e.g., 1"). The wrench 100 is similar to the wrench 10, 10', 10B, and common elements have common reference numbers "C".

The wrench 100 also has an extended tooth 38C. The wrench 100 also includes a small notch 50C defined on the bottom edge proximate the base of the hook member 18C.

Figure 14A:
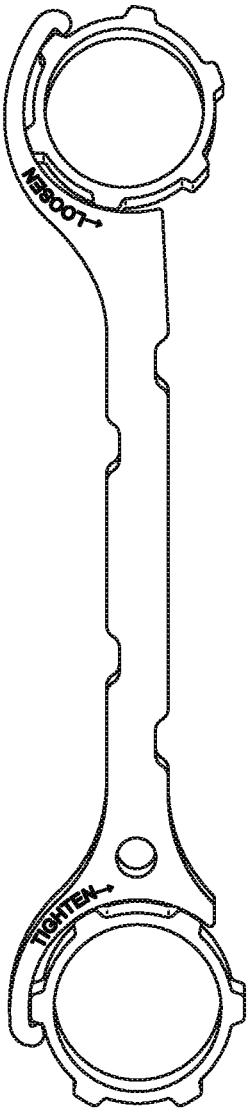
FIG. 14A is a side view of a wrench similar to the wrench shown in FIG. 11A-11B and engaged with locknuts.
Figure 14B:
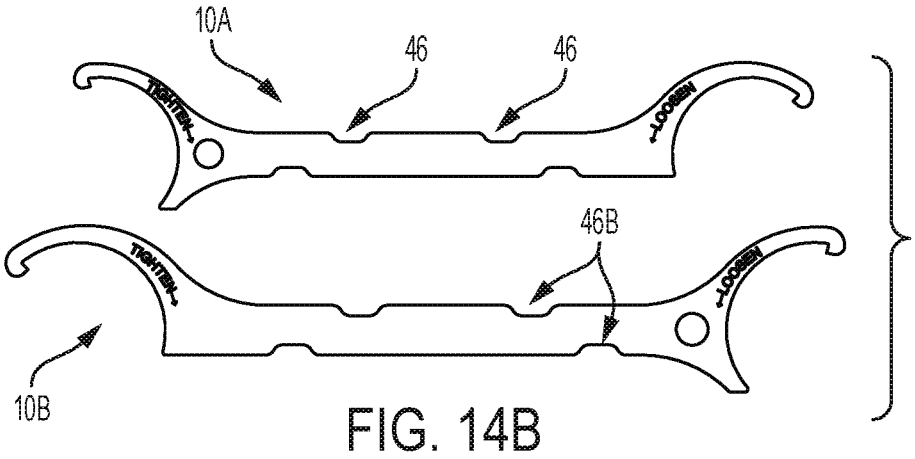
FIG. 14B illustrates a comparison of wrenches for different size locknuts.

It should be understood that a feature shown in one construction of a wrench but not shown in another construction of the wrench may be included the other construction(s). For example, the notches 46 of the wrench 10A may be included in the wrench 10, 10', 10B, 100 (see FIG. 14B illustrating the wrench 10B with notches 46B).

Thus, the invention may generally provide, among other things, a wrench having a hook portion at each end extending around different angles. The wrench may have a hook portion including a hook member on one longitudinal side of the handle and a tooth on the opposite longitudinal side of the handle to extend the engagement surface of the hook portion.

One or more independent features and/or independent advantages of the invention may be set forth in the following claims:

What is claimed is:

1. A wrench comprising:

a first hook portion having a first hook base, a first hook end with a single first hook member, and a concave first hook inner surface extending between the first hook base and the a single first hook member, the single first hook member extending radially inwardly from the first hook inner surface;

a second hook portion having a second hook base, a second hook end with a single second hook member, and a concave second hook inner surface extending between the second hook base and the single second hook member, the single second hook member extending radially inwardly from the second hook inner surface, the second hook portion including a tooth extending from the second hook base and positioned on an opposite longitudinal side of the handle from the single second hook member;

a handle having a first edge and an opposite second edge extending along a longitudinal axis, the handle connecting the first hook portion to the second hook portion;

wherein the first hook base and the second hook base are aligned relative to the longitudinal axis and located proximate the first edge;

wherein the first hook inner surface defines a first arc having a radius of curvature and extending along a first angle subtended by the first arc between the first hook base and the first hook end, and the second hook inner surface defines a second arc having the radius of curvature and extending along a second angle subtended by the second arc between the second hook base and the second hook end, the second angle being different than the first angle;

wherein the first hook portion and the second hook portion are one longitudinal side of the handle in a plane defined by the first hook portion, the second hook portion, and the handle and open in a direction toward the first edge of the handle;

wherein the first hook portion and the second hook portion each have one face arranged in the first face plane and an opposite face arranged in a second face plane, the first face plane and the second face plane being on opposite sides of and parallel to the plane; and wherein the first hook portion, the second hook portion and the handle are between the first face plane and the second face plane.

2. The wrench of claim 1, wherein the first angle is greater than the second angle.

3. The wrench of claim 2, wherein the first hook angle is at least 120°.

4. The wrench of claim 3, wherein the first angle is about 135°.

5. The wrench of claim 4, wherein the second angle is about 105°.

6. The wrench of claim 1, wherein the tooth has a tooth base, a tooth end, and a tooth inner surface extending between the tooth base and the tooth end, the tooth inner surface defining a third arc having the radius of curvature and extending along a third angle subtended by the third arc between the tooth base and the tooth end.

7. The wrench of claim 6, wherein the first angle is greater than a total of the second angle and the third angle.

8. The wrench of claim 1, wherein the single first hook member has an engagement surface arranged at an angle relative to a radial line.

9. The wrench of claim 8, wherein the single second hook member has an engagement surface arranged at an angle relative to a radial line.

10. The wrench of claim 1, wherein a recess is defined in one of the first edge and the second edge of the handle.

11. The wrench of claim 10, wherein a first recess is defined in the first edge and a second recess is defined in the second edge.

12. The wrench of claim 11, wherein the first recess and the second recess are offset along the axis.

13. The wrench of claim 10, wherein a plurality of recesses is defined in the one of the first edge and the second edge.

14. The wrench of claim 13, wherein a plurality of first recesses is defined in the first edge and a plurality of second recesses is defined in the second edge.

15. The wrench of claim 14, wherein each of the first recesses is offset along the axis from each of the second recesses.

16. The wrench of claim 1, wherein the first hook inner surface defines the first arc about a first axis and the second hook inner surface defines the second arc about a second axis, and wherein the first hook portion and the second hook portion extend in opposite directions about the first axis and the second axis, respectively.

17. The wrench of claim 1, wherein the first hook inner surface and the second hook inner surface extend from proximate the first edge and beyond the second edge.

18. The wrench of claim 1, wherein the first hook portion is dimensioned to engage and operable to adjust a nut of a size, the second hook portion being dimensioned to engage and operable to adjust the nut of the size.

19. The wrench of claim 1, wherein the first hook base and the second hook base are along a line parallel to the longitudinal axis.

20. The wrench of claim 1, wherein the first hook portion, the second hook portion and the handle are planar.

* * * * *